United States Patent [19]

Bingham

[11] 3,943,470

[45] Mar. 9, 1976

[54] RIGHT ANGLE CONNECTOR

[75] Inventor: Chalice Bingham, Oak Ridge, Tenn.

[73] Assignee: Sealectro Corporation, Marmaroneck, N.Y.

[22] Filed: Sept. 20, 1974

[21] Appl. No.: 507,741

Related U.S. Application Data

[63] Continuation-in-part of Ser. No. 386,204, Aug. 6, 1973, abandoned.

[52] U.S. Cl. ..... 333/97 R; 333/33; 333/96

[51] Int. Cl.[2]..... H01P 1/02; H01P 3/06; H01P 5/02

[58] Field of Search..... 333/96, 97 R, 98 BE, 33, 333/35, 73 C; 174/21 C, 21 CA, 75 C, 88 C, 19

[56] References Cited

UNITED STATES PATENTS

| | | | |
|---|---|---|---|
| 2,029,420 | 2/1936 | Green | 174/28 X |
| 2,152,504 | 3/1939 | Scott et al. | 174/75 |
| 2,165,961 | 7/1939 | Cork et al. | 333/97 X |
| 2,437,067 | 3/1948 | Bingley | 174/88 C X |
| 2,510,358 | 6/1950 | Wolf | 174/28 X |
| 2,530,064 | 11/1950 | Jones | 333/97 R |
| 2,952,823 | 9/1960 | Robinson | 333/97 |
| 3,777,371 | 12/1973 | Iyengar et al. | 333/96 X |

OTHER PUBLICATIONS

Whinnery- et al.- "Coaxial-Line Discontinuities," in Paroc. IRE, Vol. 32, No. 11, Nov. 1944; pp. 695-709.

*Primary Examiner*—Eli Lieberman
*Assistant Examiner*—Marvin Nussbaum
*Attorney, Agent, or Firm*—Anthony J. Casella

[57] ABSTRACT

An angular coaxial connector for use in ultrahigh frequency systems where the impedance of the conductor must be kept within a minimum tolerance to avoid unwanted reflections. To avoid complicated structures, air is used as the dielectric in the bend portion of the angle and the radius of the air and insulator portions of the system is so proportioned that the voltage standing wave ratio (VSWR) is maintained at 1 and the impedance of the line is constant.

4 Claims, 4 Drawing Figures

RIGHT ANGLE CONNECTOR

This is a continuation-in-part of U.S. application Ser. Number 386,204, filed Aug. 6, 1973 and entitled "RIGHT ANGLE CONNECTOR", now abandoned which application is assigned to the same assignee of the subject application.

BACKGROUND OF THE INVENTION

The transfer of ultra-high frequency power presents many problems, the most important one being the prevention of radiation from the conductors leading from a source of power to a measuring system or a transmission device such as an antenna or a heating system. In this regard, the concentric line has been found to be quite suitable provided the impedance of the line is constant and does not vary from a desired input-output value. Any variation in impedance results in reverse flow reflections which reduce the efficiency, increase radiation, and introduce errors into any measuring systems or transmission device that may be employed.

Bends in a concentric line should have the same insulator-dielectric as the linear portions of the system, but these bends are very expensive to fabricate and difficult to hold to the proper dimensions. Dielectric powder material has been used in the bends but such a construction has its problems and unless the powder is firmly packed, reflections will occur.

Current sophisticated microwave systems have created the need for high-performance broadband interconnecting devices. This requirement has been substantially met by several series of straight connectors. However, angular connectors have not been utilized due to their inferior voltage standing wave rates (VSWR) characteristics over a limited frequency range. Present and future systems, with increased emphasis being placed on packaging factors, will demand the use of right angle connectors whose electrical performance is comparable to similar types of straight connectors.

The usual procedure in forming connectors of this type has been to use a two-piece contact and insulator design to form the right angle, and solder the two straight contacts together. The cavity surrounding the joint is then filed with insulating material, or the cavity may be left unfilled, with air acting as the dielectric. This device gives poor electrical performance due primarily to the varying relationships between the outer diameter of the inner conductor and the inner diameter of the outer conductor.

Other means of forming right angles has been with the use of a singular contact in conjunction with an insulator, or with the dielectric of the cable itself forming the bend. In the latter case, a metallic insert encompassing the apex of the bend is utilized as the outer conductor. The insert is shaped so that it provides an equidistant surface with respect to the inner conductor around the bend, however, outer conductor irregularites at the inside portion of the bend result in impedance discontinuities. In addition, this configuration is limited by the size of the cable dielectric core, due to the difficulty encountered in bending cables of approximately 0.2 inch (5.1 mm.) or more in diameter.

Another design of a right angle connector is described in U.S. Pat. No. 3,528,052, which issued to A. R. Brishka on Sept. 8, 1970 and is assigned to the same assignee of the subject invention. This design consisted of a singular contact surrounded by a TFE dielectric forming a 90° bend terminating in 2 mating faces. The outer diameter of the dielectric was 0.306 inches (7.77 mm.) bent around a radius of 0.125 inch (3.17 mm.). A metallic insert was machined to surround the apex of the bend and all remaining cavities were filled with fine metallic particles. Test results indicated the addition of the metallic particles improved the performance of the connector considerably. Consequently, the insert was completely replaced by metallic particles. The connector exhibited even better electrical characteristics, however, it was mechanically unfeasible to distribute the particles efficiently in order to completely surround the dielectric. The use of epoxies was limited by the unavailability of those which would exhibits high electrical conductivity. These problems were solved by plating the dielectric with silver thus providing a continuous outer conductive coating. Mechanical and electrical tests indicated that a low impedance section existed in the region of the bend. The optimum configuration for the elbow at the completion of the bending process would be a condition such that the center conductor be equi-distant from the outer surface of the dielectric at all planes which are perpendicular to the axis of the bent assembly. However, due to the sharpness of the bend and the physical properties of the materials used, the above condition does not exist. Instead, when the assembly was bent, the dielectric stretched and the center conductor tended to move radially outward at the apex of the bend. This resulted in a lower cross-sectional area at the elbow and thus, when the assembly was plated or surrounded by conductive particles, the impedance at this section was lowered. In order to achieve a satisfactory electrical performance, compensation in this region was required for the impedance discontinuity. To accomplish this, a method (simulating an increased outer conductor) of introducing a high impedance section for compensation purposes was effected by removing the conductive material at the apex of the elbow. Improved VSWR and impedance characteristics were obtained, however, the range of frequency was limited to a usable frequency range of up to 10 GHz. In addition to the limitation of the frequency range of the last mentioned prior art design, it is noted that such design is relatively complicated to construct in that the amount of conductive material removed is very critical. Thus the cost of manufacture is relatively high and maximum quality control must be exercised during the manufacture of the design. Furthermore, the limited frequency range of this prior design limits its capability of use for certain high radio frequency applications greater than 10 GHz, for example in the range 12 —18 GHz.

More particularly, the subject invention relates to a 90° radio frequency coaxial connector having improved radio frequency performance that is achieved by using an air filled dielectric, a smooth radio transition of the outer conductor at the 90° bend, and a preformed smooth radio transition at the center conductor. A matched characteristic impedance section throughout the 90° transition is achieved by maintaining constant diameter ratios between the inner and outer conductors. The inner conductor is preformed before assembly thus maintaining the heat treated spring properties required for connector interfaces requiring spring member female inner conductors. The subject design also employs non-heat treated inner conductors for interfaces requiring male pin inner conductors. The use of heat treated elements facilitates the manufacture and accordingly reduces the cost of manufacture of the subject connector.

In order to maintain constant inner and outer diameter ratios, thus maintaining a matched characteristic impedance, the outer diameter of the inner conductor is held concentric with the inner diameter of the outer conductor by means of dielectric supports disposed in recesses at the ends of the outer conductor. The use of an air dielectric allows for a constant dielectric constant to maintain the matched characteristic impedance which may otherwise be distorted when employing solid material dielectrics. The inner face of the subject connector may be of varying configurations and the back end thereof may accept a cable or a panel, according to the specific application.

SUMMARY

The present invention uses an air space around the bend portion of the connector to act as an insulator and dielectric, the radius of the air space being so proportioned to the radius of the solid insulator that the impedance of the line remains the same.

The invention includes an angular connector in a concentric line system, having a central conductor, an annular sleeve of insulation surrounding the central conductor, and an outer conductive sheath surrounding the insulation sleeve. A solid material such as polytetrafluoroethylene* is used for all linear sections of the line and an air space is used between the outer sheath and the central conductor for all angular turns. The radial thickness of the solid dielectric 14 is 1.413 times the radial thickness of the air space 12 for retaining a constant line impedance in all portions of the line and eliminating voltage standing reflections.

Additional details of the invention will be disclosed in the following description, taken in connection with the accompanying drawings.

*Sold under trademark "Teflon" of Dupont

DESCRIPTION OF THE PREFERRED EMBODIMENT

Figure 1:
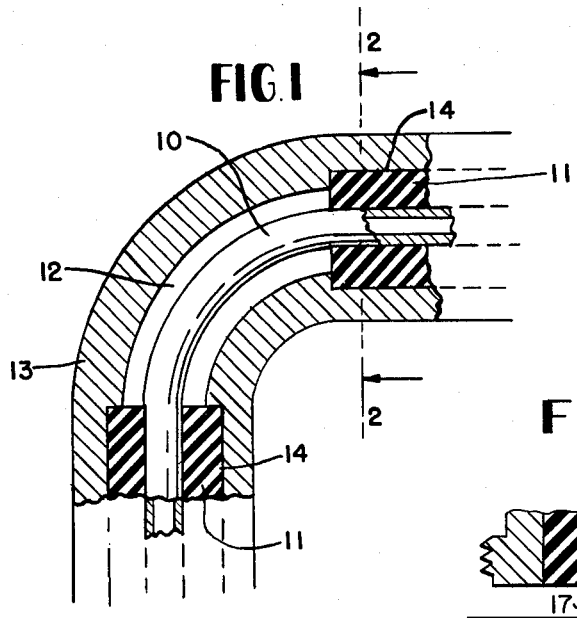
FIG. 1 is a cross sectional view, taken along a median plane, of the angular section of the concentric line.
Figure 2:
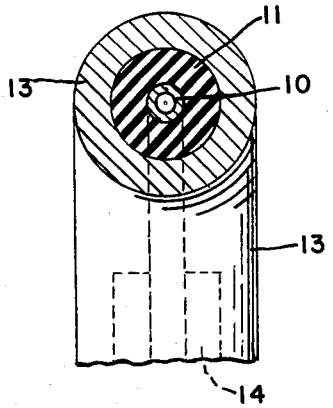
FIG. 2 is a cross sectional view of the connector shown in FIG. 1 and is taken along line 2 —2 of that figure.

Referring now to FIGS. 1 and 2, the right angle connector includes a central conductor 10 which may be solid or formed from a tube as shown. At its ends the conductor 10 is secured in place by solid insulator sleeves 11 but around the curved portion of the central conductor, an annular air space 12 is provided. An outer sheath 13 of conductive material is provided for forming the return path of the ultra-high frequency currents. The sheath 13 is usually grounded.

In order to securely position the curved conductor 10 in its desired position, a recess 14 is formed in each end of the outer sheath and the ends of the solid dielectric 11 firmly seated in each. It is evident from the drawing (FIG. 1) that the solid dielectric is larger in diameter than the air space. The ratios of the radial thicknesses of the air space to the solid dielectric is quite important since this ratio defines the ratios of the electric impedance values of the two line portions. By calculation and experiment, it has been found that for one embodiment of the invention, the ratio of diameters for a Teflon dielectric is 3.25, that is, the diameter of the Teflon dielectric 11 should be 3.25 times the diameter of the inner conductor. When air is used as the dielectric ratio of diameters is 2.3. These coefficients apply to 50 ohm lines only.

The ohmic impedance of any concentric line may be expressed:

$$Z = \frac{138.2}{k} \log X$$

where $z$ = the ohmic impedance of the line, $k$ = the dielectric constant of the insulator, ($k = 2.1$ for Teflon and 1 for air) and $x$ = the ratio of the radii of the conductors, outer to inner.

In order to make the impedances of the air and Teflon sections equal, and thereby eliminate reflection losses, it is evident that $$\frac{138.2}{2.1} \log X_T \text{ (Teflon)} = 138.2 \log X_A \text{(air)}$$

$$\text{or } X_t = X_a^{1.45},$$

that is, the ratios of the inner and outer conductor radii for a Teflon insulated line must be equal to the same ratio for air raised to the 1.45 power (the square root of $k$).

The outer conductor 13 or sheath is made of a conductive non-magnetic material, preferably of beryllium copper. The preferred material for the inner conductor is made of one piece, and is also made of beryllium copper.

It should be noted that the right angle connector, as illustrated in FIGS. 1 and 2, is quite easy to fabricate. After the parts have been made by casting or bending, the inner conductor 10 is inserted into the hollow outer conductor 13, clamped into place by a jig holding one end, and the Teflon insulator 11 pressed into place at the other end. Then the second insulator is pressed into place and the connector is finished. Any type of connecting means can be used to connect the ends of the connector to the linear portions of the line.

Figure 3:
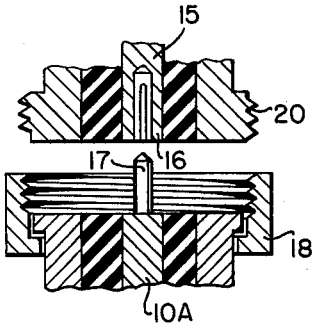
FIG. 3 is a cross sectional view of an alternate form of the invention employing a spring clip connector means.

The angular connector shown in FIG. 3 is similar to that shown in FIG. 1 except that the central conductor 15 is solid and that the bend is terminated by a detachable connector means. The end of the central conductor is formed with a split section 16 for receiving a connecting pin 17, connected to the inner conductor 10A of another section of the coaxial cable. The usual threaded clamping nut 18 screws onto a threaded portion 20 when the parts are joined.

From the avove it is readily appreciated that applicant's invention provides a single, unitary construction including the preformed, heat treated inner spring conductor that is of importance with respect to meeting military requirements for withstanding repeated bending or fatigue loading. The single unitary construction is of particular importance also since it is used specially in the UHF to EHF range, i.e., the microwave region, the GHZ range. Unitary construction is important because any discontinuity will cause reflections, increasing the VSWR, distorting the signal, and increasing noise on the line.

As an example of the utility of the subject invention, tabulated below is a computer read-out of a 50 ohm test coaxial connector made according to the subject invention. Column 1 lists the frequency in MHZ of the signal provided to the specimen connector, while the second column lists the VSWR for each frequency signal. As is readily apparent, the optimum ratio is 1, and from the test data prepared, the VSWR varies over the relatively insignificant range of 1.013 to 1.121 for a frequency range from 2 through 18 GHZ. The significance of this data will be further appreciated from a review of FIG. 4 as fully discussed below.

Column 3 sets forth the reflection magnitude for signal-to-noise ratio, while Column 4 lists the phase displacement of the signal, and Column 6 lists the impedance measurements. The computor read-out is as follows:

| FREQ MHZ | VSWR | REFL-MAG | ANGLE DEG | R-OHMS |
|---|---|---|---|---|
| 2000.000 | 1.013 | .007 | −65.739 | 50.195 |
| 2250.000 | 1.016 | .008 | −103.826 | 49.805 |
| 2500.000 | 1.021 | .010 | −139.858 | 49.219 |
| 2750.000 | 1.022 | .011 | −147.641 | 49.023 |
| 3000.000 | 1.036 | .018 | −152.129 | 48.438 |
| 3250.000 | 1.049 | .024 | −173.367 | 47.705 |
| 3500.000 | 1.052 | .025 | 171.153 | 47.510 |
| 3750.000 | 1.056 | .027 | 163.220 | 47.461 |
| 4000.000 | 1.057 | .028 | 157.005 | 47.510 |
| 4250.000 | 1.063 | .030 | 153.564 | 47.314 |
| 4500.000 | 1.077 | .037 | 145.839 | 46.973 |
| 4750.000 | 1.088 | .042 | 133.449 | 47.070 |
| 5000.000 | 1.087 | .042 | 123.762 | 47.607 |
| 5250.000 | 1.085 | .041 | 121.806 | 47.803 |
| 5500.000 | 1.090 | .043 | 117.588 | 47.949 |
| 5700.000 | 1.093 | .045 | 113.580 | 48.096 |
| 6000.000 | 1.098 | .047 | 107.786 | 48.389 |
| 6250.000 | 1.101 | .048 | 102.138 | 48.828 |
| 6500.000 | 1.103 | .049 | 96.921 | 49.170 |
| 6750.000 | 1.105 | .050 | 92.955 | 49.512 |
| 7000.000 | 1.105 | .050 | 88.054 | 49.951 |
| 7250.000 | 1.101 | .048 | 84.674 | 50.195 |
| 7500.000 | 1.099 | .047 | 87.606 | 49.951 |
| 7750.000 | 1.105 | .050 | 88.103 | 49.951 |
| 8000.000 | 1.109 | .052 | 84.532 | 50.293 |
| 8250.000 | 1.105 | .050 | 81.063 | 50.586 |
| 8500.000 | 1.107 | .051 | 79.465 | 50.684 |
| 8750.000 | 1.104 | .050 | 79.657 | 50.684 |
| 9000.000 | 1.108 | .051 | 79.983 | 50.684 |
| 9258.000 | 1.113 | .054 | 77.372 | 50.879 |
| 9500.000 | 1.111 | .053 | 75.254 | 51.074 |
| 9750.000 | 1.108 | .051 | 74.540 | 50.684 |
| 10000.000 | 1.109 | .052 | 75.684 | 51.074 |
| 10250.000 | 1.114 | .054 | 76.734 | 50.977 |
| 10500.000 | 1.119 | .056 | 73.271 | 51.367 |
| 10750.000 | 1.116 | .055 | 67.907 | 51.855 |
| 11000.000 | 1.111 | .053 | 66.504 | 51.855 |
| 11250.000 | 1.108 | .051 | 67.490 | 51.758 |
| 11500.000 | 1.114 | .054 | 69.650 | 51.660 |
| 11750.000 | 1.121 | .057 | 68.568 | 51.855 |
| 12000.000 | 1.121 | .057 | 64.506 | 52.246 |
| 12250.000 | 1.112 | .053 | 62.140 | 52.344 |
| 12400.000 | 1.103 | .049 | 61.429 | 52.246 |
| 13500.000 | 1.103 | .049 | 60.848 | 52.246 |
| 13750.000 | 1.101 | .048 | 61.262 | 52.246 |
| 14000.000 | 1.097 | .046 | 57.858 | 52.344 |
| 14250.000 | 1.090 | .043 | 55.114 | 52.441 |
| 14500.000 | 1.086 | .041 | 55.579 | 52.246 |
| 14750.000 | 1.086 | .041 | 57.643 | 52.148 |
| 15000.000 | 1.086 | .041 | 59.891 | 52.051 |
| 15250.000 | 1.081 | .039 | 65.171 | 51.465 |
| 15500.000 | 1.079 | .038 | 74.712 | 50.879 |
| 15700.000 | 1.075 | .036 | 81.284 | 50.391 |
| 16000.000 | 1.077 | .037 | 87.971 | 50.000 |
| 16250.000 | 1.086 | .041 | 85.371 | 50.195 |
| 16500.000 | 1.091 | .043 | 82.585 | 50.391 |
| 16750.000 | 1.102 | .048 | 86.955 | 50.000 |
| 17000.000 | 1.120 | .057 | 84.358 | 50.293 |
| 17250.000 | 1.110 | .052 | 84.732 | 50.195 |
| 17500.000 | 1.101 | .048 | 94.004 | 49.414 |
| 17750.000 | 1.101 | .048 | 105.630 | 48.486 |
| 17999.988 | 1.113 | .054 | 114.668 | 47.607 |

Figure 4:
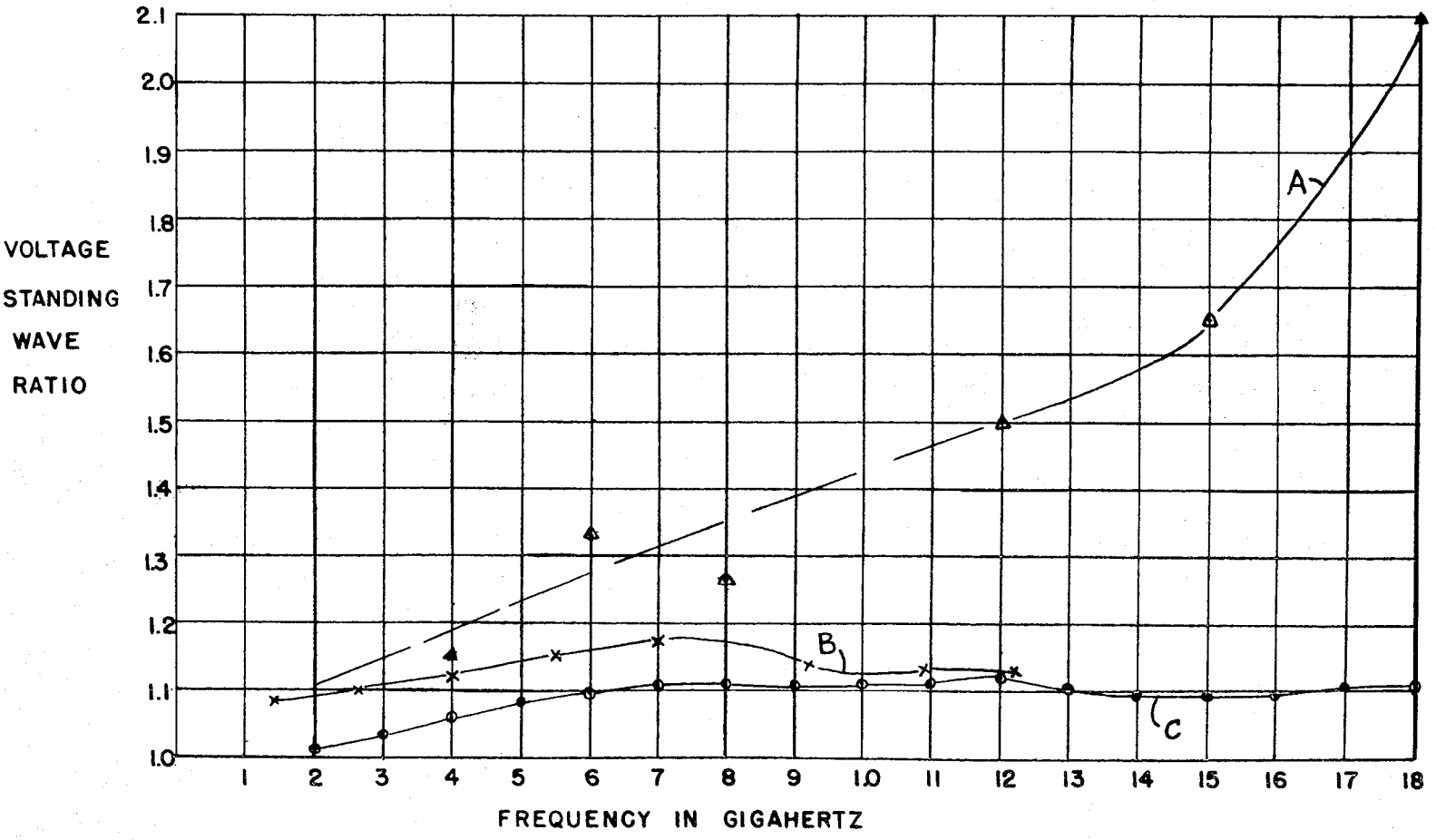
FIG. 4 is a graph of several curves of frequency versus VSWR for several right angle connectors including the subject angular coaxial connector.

Referring now to FIG. 4, there is illustrated a graph of the test results of three angular connectors to which a variable high frequency signal was applied, with measurements being made at incremental frequencies of the voltage standing wave ratio. Curve "A" is for a conventional right angle connector of the type wherein two straight contacts are soldered together. As accordingly shown in FIG. 4, with the increase in frequency from 2 through 18 GHZ, the VSWR increases from approximately 1.1 to over 2.0. Curve "B" represents the test data obtained from a right angle connector made according to U.S. Pat. No. 3,528,052, as mentioned above. Because of the construction of such connector in that portions of the plating apply to the conductive material covering the dielectric surrounding the central conductor, the frequency range and capability of this connector is limited to an upper limit of approximately 12 GHZ. Accordingly, although the connector measured in the curve "B" has a variation of its VSWR of 1 to approximately 1.172, it is limited in its operational frequency range to approximately 12 GHZ. As is readily apparent for ultra high frequency applications, such as in satellite communication systems and the like, this limitation of frequency operational range limits the use of such connectors. On the other hand, referring to Curve "C" which represents the test data obtained from the testing of an angular coaxial connector made in accordance with the subject invention, it is seen that, although the frequency range extends from 2 through 18 GHZ, the VSWR is relatively flat, and in fact, ranges from 1.013 to 1.121, with the exact readings being set forth above in the tabulated computer reader. Accordingly, there is provided a new and improved angular coaxial connector that is particularly adapted for use in the UHF and EHF range, i.e., the microwave region, the GHZ frequency range. As illustrated in the drawings, and as described above, the specific construction of the subject angular coaxial cable includes an outer tubular sheath as is made of a conductive material and includes annular recessed portions disposed adjacent each end thereof. With reference to FIG. 1, the angular coaxial connector may be designed such that the tubular sheath 13 includes linear end portions, and an intermediate angular portion. Solid insulator materials are disposed in each annular recess and the central conductor extends concentrically through the solid insulators and the angular tubular air space within the tubular sheath within the insulators. The radial frequency performance of the subject connector is improved by using the air-filled dielectric, a smooth radial transition of the outer conductor at the 90° bend, and the preformed smooth radial transition at the central conductor.

Although the invention has been described with reference to a particular embodiment, it is apparent that modifications and adaptations thereof may be readily apparent to those skilled in the art, and hence the scope of the invention should be limited only by the following appended claims.

The embodiments of the invention in which an excluse property or privlege is claimed are defined as follows:

1. A coaxial connector, extending 90° along a circular arc, for high frequency applications comprising: an outer tubular sheath extending 90° along a circular arc and made of a conductive material having an inner surface defining a space for an air dielectric, said tubular sheath including annular recessed portions disposed adjacent each end thereof, said annular recesses being in the internal surface of the tubular sheath; a cylindrical solid insulator material disposed in each annular recess; and a central conductor extending 90° along a circular arc and concentrically through said solid insulators and the tubular air space within said sheath between said insulators; the radial thicknesses of the solid insulator materials and the radial thickness of the air space in combination with their dielectric constants providing a constant ohmic impedance in all portions of the line.

2. An angular coaxial connector as in claim 1 wherein the central conductor, the insulator material, and the inner surface of the outer tubular sheath are all of circular cross sections.

3. An angular coaxial connector as in claim 1 wherein the solid insulator material is polytetrafluorethylene.

4. An angular coaxial connector as in claim 1 wherein the central conductor is preformed prior to final assembly.

* * * * *